United States Patent [19]

Moeller

[11] 4,215,645

[45] Aug. 5, 1980

[54] SHOCK CRUSH SUB-FOUNDATION

[76] Inventor: Kurt G. F. Moeller, R.F.D. #3, Annapolis, Md.

[21] Appl. No.: 858,827

[22] Filed: Dec. 10, 1959

[51] Int. Cl.[3] ..... B63G 8/40

[52] U.S. Cl. ..... 114/336; 114/219; 89/36 J

[58] Field of Search ..... 114/0.5, 1, 13, 69, 114/70; 9/3; 89/36; 248/20, 21, 22, 2, 3, 4, 5, 6–13

[56] References Cited

U.S. PATENT DOCUMENTS

| | | | |
|---|---|---|---|
| 210,811 | 12/1878 | Serrell | 89/36 J X |
| 775,889 | 11/1904 | Blockmann | 114/69 X |
| 965,537 | 7/1910 | Poeppelmeier | 267/170 X |
| 2,055,383 | 9/1936 | Loyd | 114/336 X |
| 2,283,484 | 5/1942 | Bak | 89/36 J X |
| 2,323,063 | 6/1943 | Long | 114/69 |

FOREIGN PATENT DOCUMENTS

| | | | |
|---|---|---|---|
| 100842 | 1/1899 | Fed. Rep. of Germany | 114/69 |

*Primary Examiner*—David H. Brown
*Attorney, Agent, or Firm*—R. S. Sciascia; Q. E. Hodges

EXEMPLARY CLAIM

1. A shock crush sub-foundation comprising a base, a frame member reinforcing said base, an equipment support member, and deformation absorbing means between said frame member and said equipment support member for absorbing plastic deformation of said base and said base frame member to prevent deformation of said support member, said deformation absorbing means comprising a hollow member containing viscous fluid and having an orifice normally sealed by a diaphragm which is designed to rupture upon plastic deformation of said base member and said frame member.

11 Claims, 3 Drawing Figures

BY

SHOCK CRUSH SUB-FOUNDATION

The invention described herein may be manufactured and used by or for the Government of the United States of America for governmental purposes without the payment of any royalties thereon or therefor.

The present invention relates to a shock-crush sub foundation and more particularly to a shock-crush sub foundation for preventing hull deformation caused by underwater explosions or other forces from effecting the alignment of internal structures, particularly machinery foundations.

In general, a ship, either surface ship or submarine, can take a great deal of damage resulting in deformation of its original geometry without losing its watertight integrity. However, such damage without rupture usually affects the internal installations to such an extent that most of the machinery in the inflicted area becomes inoperable. This renders the ship dead in the water, but afloat, presenting a very undesirable descrepancy between resistance of the hull and that of the machinery; the ship should be operable as long as it is afloat.

Conventional ship construction, aimed at taking protective action against the effects of shock accelerations, utilizes members of sufficient structure strength in conjunction with shock absorbers and/or crushable intermediate layers of corrugated steel.

Shock absorbers can be utilized effectively with deformations up to about one inch. Corrugated steel for sufficient structural strength is also practically limited to deformations of about one inch. Corrugated steel also has the disadvantage that it is effective for but one blow after which it must be replaced since it has been flattened.

Experience has indicated that hull deformations of 10 inches may be experienced without rupture. Therefore in spite of the fact that the ship remains afloat, it is often not operable because the deformation of the hull caused misalignment of propulsion machinery or other gear necessary for the ship's operation.

The present invention introduces a danger zone into the internal design of a ship which encompasses a space or layer of predetermined thickness equal to the maximum deflection that the particular hull can take without rupture. The danger zone is bridged by special members which are able to follow the deformation without loosing their static load carrying ability.

It is therefore an object of this invention to provide an improved machinery sub foundation for ships.

Another object is the provision of a machinery sub foundation which will allow maximum hull deformation without misalignment of the machinery.

A further object is the provision of a machinery sub foundation which will keep a ship operable as long as she is afloat and decrease the possiblity of detection by an enemy.

Other objects and many of the attendant advantages of this invention will be readily appreciated as the same becomes better understood by reference to the following detailed description when considered in connection with the accompanying drawings wherein.

Figure 1:
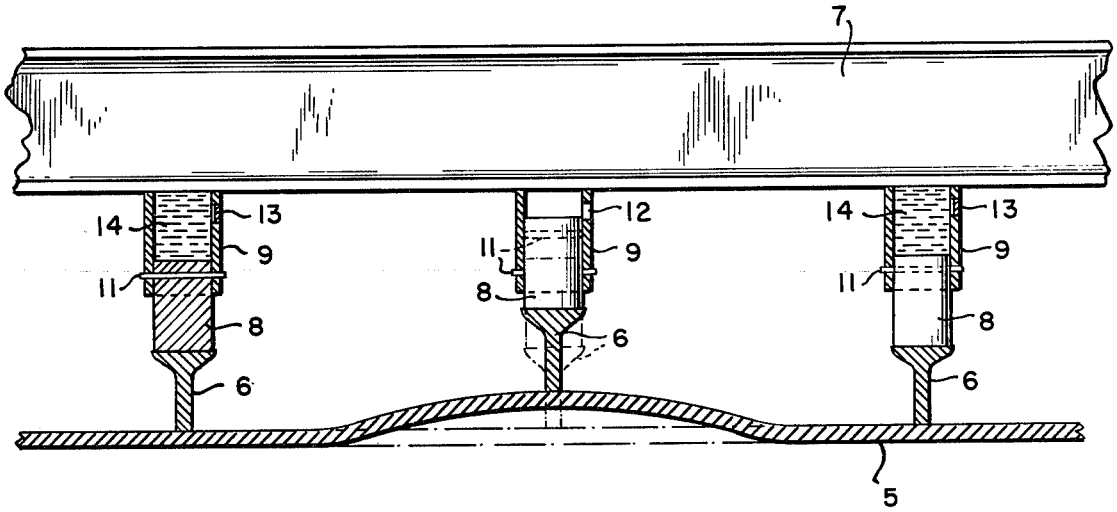
FIG. 1 is a plan view partly in section showing a preferred embodiment of the invention in operation.

Referring to the drawings, wherein like reference characters designate like or corresponding parts throughout the several views, there is shown in FIG. 1 (which illustrates a preferred embodiment) a base represented by a hull 5 which may be a submarine pressure hull or alternatively the hull of a surface ship. Reinforcing hull 5 are a plurality of frame members 6 which support a machinery or equipment support member on foundation exemplified by I-beam 7.

This foundation is spaced from the top flange of the beam a distance approximately equal to twice the maximum permissible deformation of the hull, by deformation absorbing means illustrated as a pair of concentric cylinders 8 and 9 joined in overlapping position by a press fit and having a shear bolt 11 passing through both cylinders. The axis of the cylinders as perpendicular to the tangent of the pressure hull. Larger cylinder 9 has an orifice 12 which is normally closed by means of a diaphragm 13. Under normal conditions a fluid 14 of suitable viscosity fills cylinder 9.

As shown in FIG. 1, the two outer supports are in normal position while the hull at the center portion has been deformed by an underwater explosion or some other force. The force has dished the hull from the position shown by the broken line.

It will be realized that a force acting on the hull and causing deformation will stress the structural members. The viscosity of the fluid in the cylinders, and the size of the orifice are chosen to discriminate between shock impacts of short duration (order of $10^{-3}$ sec) which normally causes only elastic displacements and forces of longer duration (order of greater than $10^{-2}$ seconds) which cause plastic deformation. For the short shock impact with its steep gradient the viscous matter presents a hard resistive block; for stresses of longer duration the diaphragm 13 ruptures, causing the fluid 14 to flow from the orifice allowing the bolts 11 to shear and the cylinders 8 and 9 are forced into each other. Thus by proper choice of the forces required to shear the bolt and the force required to force the cylinders together as well as proper choice of the viscosity of the fluid and orifice size it is possible to design a force-displacement-time diagram corresponding to the stress-strain diagram of the hull portion involved.

Figure 2:
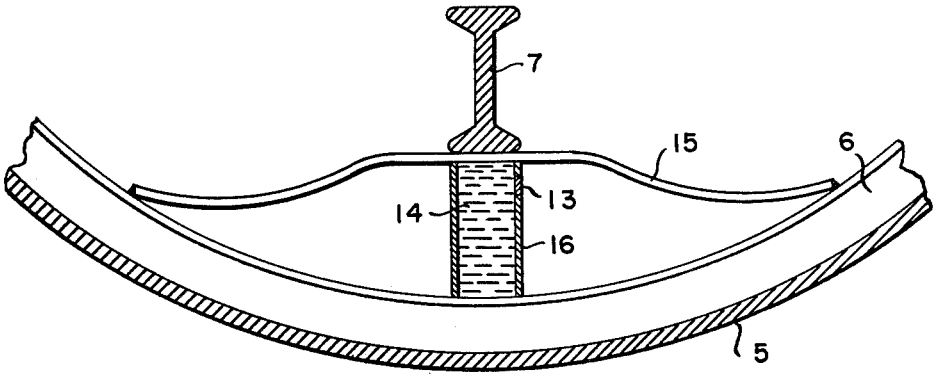
FIG. 2 is a plan view of an alternative embodiment.
Figure 3:
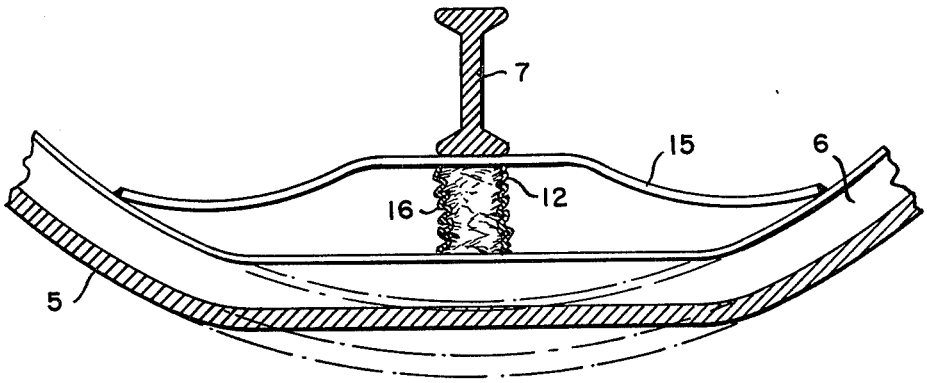
FIG. 3 is a view of the embodiment of FIG. 2 after deformation.

FIGS. 2 and 3 show an alternative embodiment of this invention. In FIG. 2 machinery support 7 is spaced from hull frame member 6 by a distance approximately equal to the maximum deformation of the hull 5. The danger zone is bridged by curved members 15 which have low bending strength vertically but are fairly stiff horizontally. Between the beam 7 and frame 6 a cylinder 16 is inserted. Cylinder 16 has just sufficient strength to take the static loading and as in the first embodiment is filled with viscous fluid 14 and has an orifice 12 covered by diaphragm 13.

Again, if the stress is of long enough duration to cause permanent deformation, the diaphragm 13 will rupture and fluid 14 will be forced from the cylinder. The force will also cause the cylinder 16 to crush and diminish its length as seen in the solid lines of FIG. 3 while curved members 15 are also deformed if the area of impact are sufficiently large.

Both embodiments utilize crushable members which are designed to have a certain strength for carrying the design load and follow deforming forces appearing as overloads as well as carry the original load in the deformed condition. It will be realized that it is insignificant whether the maximum deformation allowed by the danger zone is caused by one heavy blow or several light blows.

It will be obvious to those skilled in the art that the absorption of the blows by the crushable members will result in a high probability of keeping the propulsion and other vital machinery mounted on the foundation in operation as long as the hull of the ship remains afloat. This will reduce considerably possible losses of ships.

Another inherent advantage of the sub-foundation principle herein disclosed is the high mechanical impedance provided which warrants a high degree of effectivness for noise isolation mounts inserted between the foundation and the machinery. These are usually applied to reduce the noise transmission from the machinery into the water and it is of particular significance that the sub-foundation has suitable criteria not only for shock protection, but also for noise control.

It will be realized that a system such as has been described utilizing a well determinated ratio of load or arresting forces to overload or deforming forces thereby keeping the device effective as long as lethal deformation does not occur will be useful in other devices besides ships and the invention has been described in relationship to a ship's hull as an example only.

Obviously many modifications and variations of the present invention are possible in the light of the above teachings. It is therefore to be understood that within the scope of the appended claims the invention may be practiced otherwise than as specifically described.

What is claimed is:

1. A shock crush sub-foundation comprising a base, a frame member reinforcing said base, an equipment support member, and deformation absorbing means between said frame member and said equipment support member for absorbing plastic deformation of said base and said base frame member to prevent deformation of said support member, said deformation absorbing means comprising a hollow member containing viscous fluid and having an orifice normally sealed by a diaphragm which is designed to rupture upon plastic deformation of said base member and said frame member.

2. The invention as defined in claim 1 wherein said deformation absorbing means include a cylinder designed to crush under predetermined stress but having sufficient strength to support said equipment support member while partially crushed, and a plurality of curved bridging members having low bending strength in the vertical direction but relatively high bending strength horizontally.

3. The invention as defined in claim 1 wherein said deformation absorbing means include a pair of concentric cylinders joined in overlapping relationship by a press fit.

4. The invention as defined in claim 3 and further including a shear bolt passing through both of said concentric cylinders.

5. A shock crushable sub-foundation comprising a ship hull, a frame member reinforcing said hull, an equipment support member, and deformation absorbing means disposed between said frame member and said support member for absorbing plastic deformation of said hull and said frame member to prevent deformation of said support member, said deformation absorbing means comprising a hollow member containing viscous fluid and having an orifice therein normally sealed by a diaphragm which is designed to rupture upon plastic deformation of said hull and said frame member.

6. The invention as defined in claim 5 wherein said deformation absorbing means include a pair of concentric cylinders joined in overlapping relationship by a pressfit.

7. The invention as defined in claim 6 and further including a shear bolt passing through both said concentric cylinders.

8. The invention as defined in claim 5 wherein said deformation absorbing means include a cylinder designed to crush under predetermined stress but having sufficient strength to support said machinery support member while crushed.

9. The invention as defined in claim 8 and further comprising a plurality of curved bridging members extending from said machinery support member to said frame member, said bridging members having low bending strength in the vertical direction while being relatively stiff horizontally.

10. A shock crush sub-foundation comprising a base, a frame member reinforcing said base, an equipment support member, and deformation absorbing means between said frame member and said equipment support member for absorbing plastic deformation of said base and said base frame member to prevent deformation of said support member, said deformation absorbing means comprising a pair of concentric cylinders joined in overlapping relationship by a press fit and a shear bolt passing through both of said concentric cylinders and designed to shear when predetermined stress is applied to opposite ends of said cylinders and thereby allow the inner cylinder to be forced into the outer cylinder.

11. A shock crush sub-foundation comprising a base, a frame member reinforcing said base, an equipment support member, and deformation absoring means between said frame member and said equipment support member for absorbing plastic deformation of said base and said base frame member to prevent deformation of said support member, said deformation absorbing means comprising a cylinder designed to crush under predetermined stress but having sufficient strength to support said equipment support member while partially crushed, and a plurality of curved briding members having low bending strength in the vertical direction but a relatively high bending strength horizontally.

* * * * *